US010823472B2

(12) United States Patent
Ding et al.

(10) Patent No.: US 10,823,472 B2
(45) Date of Patent: Nov. 3, 2020

(54) REFRIGERATION SYSTEM AND CONTROLLING METHOD FOR STARTING THE REFRIGERATION SYSTEM

(71) Applicant: Carrier Corporation, Palm Beach Gardens, FL (US)

(72) Inventors: Haiping Ding, Shanghai (CN); Michael Stark, Mooresville, NC (US); Lihui Yang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 260 days.

(21) Appl. No.: 15/781,945

(22) PCT Filed: Dec. 6, 2016

(86) PCT No.: PCT/US2016/065136
§ 371 (c)(1),
(2) Date: Jun. 6, 2018

(87) PCT Pub. No.: WO2017/100186
PCT Pub. Date: Jun. 15, 2017

(65) Prior Publication Data

US 2018/0356137 A1 Dec. 13, 2018

(30) Foreign Application Priority Data

Dec. 8, 2015 (CN) ..... 2015 1 0892837

(51) Int. Cl.
*F25B 41/06* (2006.01)
*F25B 49/02* (2006.01)

(52) U.S. Cl.
CPC ..... *F25B 41/065* (2013.01); *F25B 49/02* (2013.01); *F25B 2500/26* (2013.01); *F25B 2600/2509* (2013.01); *F25B 2600/2519* (2013.01)

(58) Field of Classification Search
CPC .... F25B 41/065; F25B 49/02; F25B 2500/26; F25B 2600/2509; F25B 2600/2519; F25B 2400/13
See application file for complete search history.

(56) References Cited

U.S. PATENT DOCUMENTS 1,106,287 A * 8/1914 Doelling ..... F25B 41/065 62/205
4,171,623 A 10/1979 Lavigne et al.
(Continued)

FOREIGN PATENT DOCUMENTS

CN 101818958 A 9/2010
CN 201662272 U 12/2010
(Continued)

OTHER PUBLICATIONS

International Search Report and Written Opinion for application PCT/US2016/065136, dated Feb. 16, 2017, 12 pages.

*Primary Examiner* — Joseph F Trpisovsky
(74) *Attorney, Agent, or Firm* — Cantor Colburn LLP

(57) ABSTRACT

A refrigeration system, including: a compressor, a condenser, an economizer, a throttle valve, and an evaporator which are connected via a pipeline; and a pneumatic valve that includes a valve body and a drive gas phase refrigerant chamber, an gas phase refrigerant outlet of the economizer being connected to an interstage gas phase refrigerant inlet of the compressor via the valve body, and the drive gas phase refrigerant chamber being connected to a low pressure portion of the refrigeration system via a first gas phase refrigerant path, the lower pressure portion having a pressure lower than that in the economizer; wherein a first valve for controlling on/off of the first gas phase refrigerant path is disposed on the first gas phase refrigerant path. The refrigeration system can avoid liquid phase refrigerant accumu-
(Continued)

lated in the economizer from entering the compressor during start to cause a liquid impact problem.

18 Claims, 3 Drawing Sheets

(56) References Cited

U.S. PATENT DOCUMENTS

| | | | | |
|---|---|---|---|---|
| 4,899,555 | A * | 2/1990 | Shaw | F25B 5/04 62/505 |
| 4,947,655 | A | 8/1990 | Shaw | |
| 5,063,750 | A * | 11/1991 | Englund | F04C 28/16 62/196.3 |
| 5,816,055 | A | 10/1998 | Ohman | |
| 6,035,651 | A | 3/2000 | Carey | |
| 6,428,284 | B1 | 8/2002 | Vaisman | |
| 6,694,750 | B1 | 2/2004 | Lifson et al. | |
| 6,938,438 | B2 | 9/2005 | Lifson et al. | |
| 6,973,797 | B2 | 12/2005 | Nemit, Jr. | |
| 7,895,852 | B2 | 3/2011 | Crane et al. | |
| 8,671,703 | B2 * | 3/2014 | Mitra | F25B 1/10 62/196.1 |
| 8,671,704 | B2 * | 3/2014 | Zimmermann | F25B 40/00 62/157 |
| 9,062,903 | B2 | 6/2015 | Sjoholm et al. | |
| 9,121,627 | B2 | 9/2015 | Kopko et al. | |
| 2006/0266063 | A1 | 11/2006 | Groll et al. | |
| 2011/0162397 | A1 | 7/2011 | Huff et al. | |
| 2012/0198868 | A1 | 8/2012 | Huff et al. | |

FOREIGN PATENT DOCUMENTS

| | | | |
|---|---|---|---|
| JP | 3334507 | B2 | 10/2002 |
| WO | 2012037223 | A2 | 3/2012 |

* cited by examiner

REFRIGERATION SYSTEM AND CONTROLLING METHOD FOR STARTING THE REFRIGERATION SYSTEM

TECHNICAL FIELD

The present invention relates to the control over a refrigeration system, and in particular, to a start control method of a refrigeration system.

BACKGROUND ART

In a two-stage compression refrigeration system, an economizer may generally be used to make up gas phase refrigerant for an intermediate stage of a compressor, to improve efficiency. A valve is generally disposed on a flow path that connects an gas phase refrigerant outlet of the economizer and an interstage gas phase refrigerant inlet of the compressor, to control on/off of the flow path. There are multiple options for the model selection of the valve herein, but they have their own advantages and disadvantages. For example, if an electromagnetic valve or an electric valve is used herein, the flow path can be switched on or switched off accurately as required according to an actual working condition, which achieves high reliability and stability, but may bring about high costs that cannot be accepted by customers.

Therefore, a pneumatic valve that also has high stability but is low in costs may be generally selected to replace the electromagnetic valve or the electric valve, and the pneumatic valve may work according to a pressure difference between an evaporator and the economizer. Specifically, when there is a pressure difference between the evaporator and the economizer, the pneumatic valve will be opened; otherwise, it will be in a closed state. However, such a working manner also has a problem, that is, during shutdown of the refrigeration system, a large amount of liquid phase refrigerant may generally be accumulated in the economizer. When the compressor has just started, a great pressure difference will cause the pneumatic valve to be opened immediately, which then may probably cause the compressor to suck in the liquid phase refrigerant from the interior of the economizer, leading to a problem such as liquid impact.

SUMMARY OF THE INVENTION

An objective of the present invention is to provide a refrigeration system which can avoid liquid phase refrigerant accumulated in an economizer from entering a compressor during start to cause a liquid impact problem.

Another objective of the present invention is to provide a start control method which can avoid liquid phase refrigerant accumulated in an economizer from entering a compressor during start to cause a liquid impact problem.

In order to implement the foregoing objectives or other objectives, the present invention provides the following technical solutions.

According to an aspect of the present invention, a refrigeration system is provided, including: a compressor, a condenser, an economizer, a throttle valve, and an evaporator which are connected via a pipeline; and a pneumatic valve that includes a valve body and a drive gas phase refrigerant chamber, an gas phase refrigerant outlet of the economizer being connected to an interstage gas phase refrigerant inlet of the compressor via the valve body, and the drive gas phase refrigerant chamber being connected to a low pressure portion of the refrigeration system via a first gas phase refrigerant path, the lower pressure portion having a pressure lower than that in the economizer; wherein a first valve for controlling on/off of the first gas phase refrigerant path is disposed on the first gas phase refrigerant path.

According to another aspect of the present invention, a start control method for the refrigeration system as described above is further provided, including: S100, keeping the first valve in a closed state before the refrigeration system starts, thereby keeping the first gas phase refrigerant path in an off state; S200, reading and analyzing a first parameter related to the stock of liquid phase refrigerant in the economizer after the refrigeration system starts; and S300, keeping the first valve in a closed state when the first parameter represents that the stock of the liquid phase refrigerant in the economizer is higher than a first threshold, wherein, at this point, the first gas phase refrigerant path is in an off state; and/or opening the first valve when the first parameter represents that the stock of the liquid phase refrigerant in the economizer is lower than the first threshold, wherein, at this point, the first gas phase refrigerant path is in an on state.

DETAILED DESCRIPTION

Figure 1:
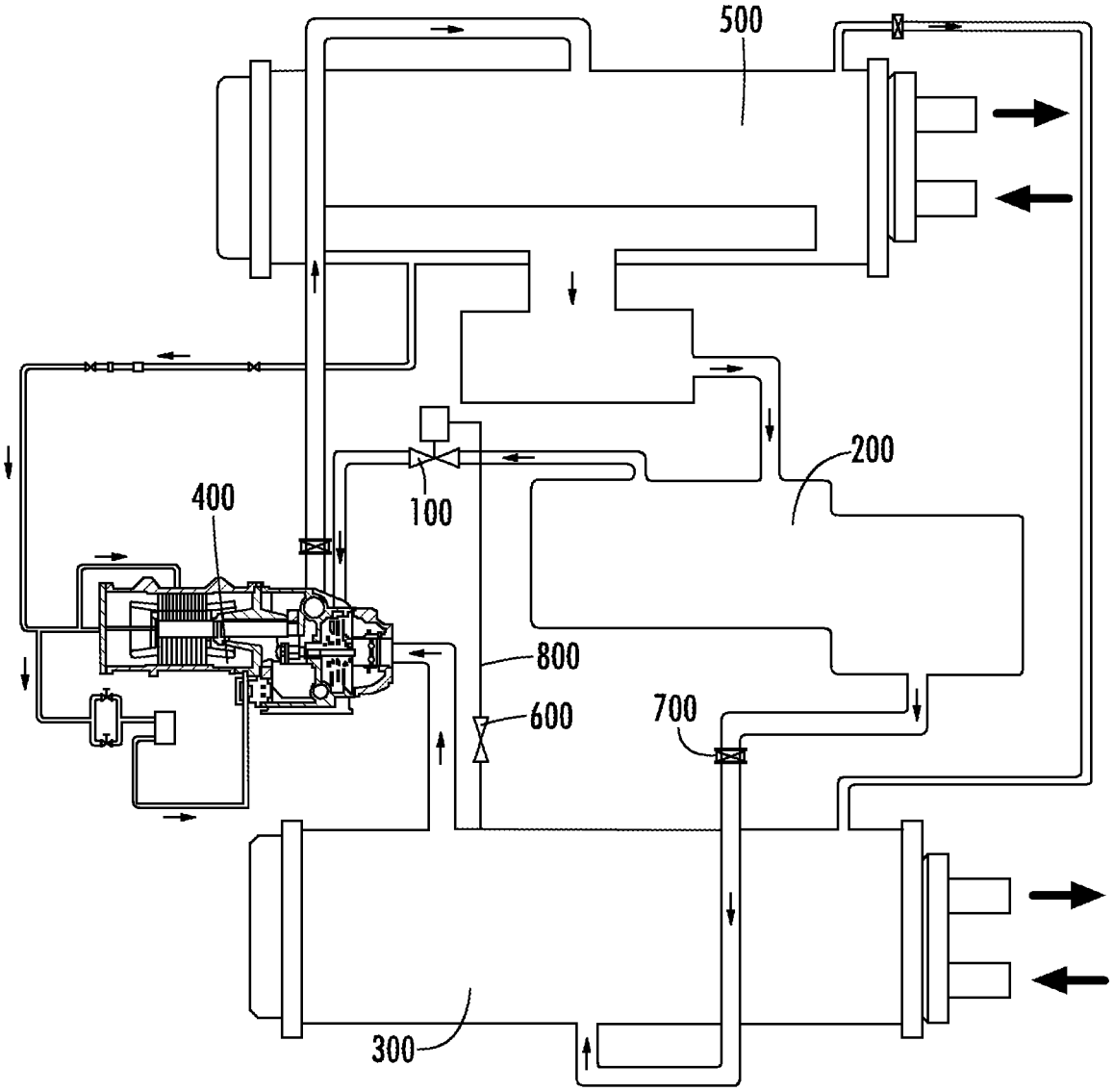
FIG. 1 is a schematic diagram of a refrigeration system according to an embodiment of the present invention.

Referring to FIG. 1, it illustrates a refrigeration system according to an embodiment of the present invention. The refrigeration system includes sequentially connected conventional components, i.e., a compressor 400, a condenser 500, an economizer 200, a throttle valve 700, and an evaporator 300. In addition, the refrigeration system further includes a pneumatic valve 100 substantially consisting of a valve body 110 and a drive gas phase refrigerant chamber 120; the specific structure of the pneumatic valve 100 will be further detailed hereinafter with reference to FIG. 2. In FIG. 1, an gas phase refrigerant outlet of the economizer 200 is further connected to an interstage gas phase refrigerant inlet of the compressor 400 via the valve body 110. In addition, the drive gas phase refrigerant chamber 120 is connected to a low pressure portion of the refrigeration system via a first gas phase refrigerant path 800.

In the present invention, the low pressure portion is required to have a pressure lower than that in the economizer 200. In this way, a positive pressure difference can be generated between the valve body 110 connected to the economizer 200 and the drive gas phase refrigerant chamber 120 connected to the low pressure portion, such that it is possible to switch on the pneumatic valve 100. According to the teaching herein, it can be known that the low pressure portion needs to be a part of the refrigeration system and also needs to have a pressure lower than that in the economizer 200. Therefore, the low pressure portion may generally be selected at a downstream portion of the economizer 200. As examples, the present invention provides several implementations. For example, the low pressure portion may be the evaporator 300, which has a pressure lower than that in the economizer 200. Preferably, in order to avoid sucking in liquid, the drive gas phase refrigerant chamber 120 may be connected to the top of the evaporator 300 via the first gas phase refrigerant path 800. For another example, when the refrigeration system is further provided with a throttle valve 700 between the economizer 200 and the evaporator 300, the low pressure portion may also be the throttle valve 700 and a downstream portion thereof. As an example, in the present invention, the throttle valve 700 is a low-side ball float valve located below the economizer 200.

More crucially, in the present invention, a first valve for controlling on/off of the gas phase refrigerant path is disposed on the first gas phase refrigerant path 800. With such design, the first valve is kept closed at a start stage of the refrigeration system or a stage in which a large amount of liquid phase refrigerant is accumulated in the economizer, and thus the pneumatic valve is also kept closed, thereby eliminating the possibility that the compressor 400 sucks in the liquid from the economizer 200.

As an example, the present invention provides an implementation of the first valve, that is, the first valve is an electromagnetic valve 600, which can better perform the function of controlling on/off of the first gas phase refrigerant path 800 herein. Compared with the solution of directly disposing an electromagnetic valve between an economizer and a compressor in the prior art, the requirements on various aspects such as performance and pressure bearing capacity of the electromagnetic valve 600 applied to the first gas phase refrigerant path 800 are all reduced significantly, and therefore the electromagnetic valve 600 has a cost much lower than that of the electromagnetic valve in the prior art. Preferably, it is more appropriate to use a normally-closed type electromagnetic valve 600 herein. This is a model selection made in consideration of the cost and reliability. For example, the normally-closed type electromagnetic valve generally has a relatively lower cost and higher reliability, and the reliability thereof may not be affected in a situation where a coil is electrified for a long term.

In addition, FIG. 1 further includes lots of common components and parts in a refrigeration system, all of which are well-known to persons skilled in the art and thus are not described in detail herein.

Figure 2:
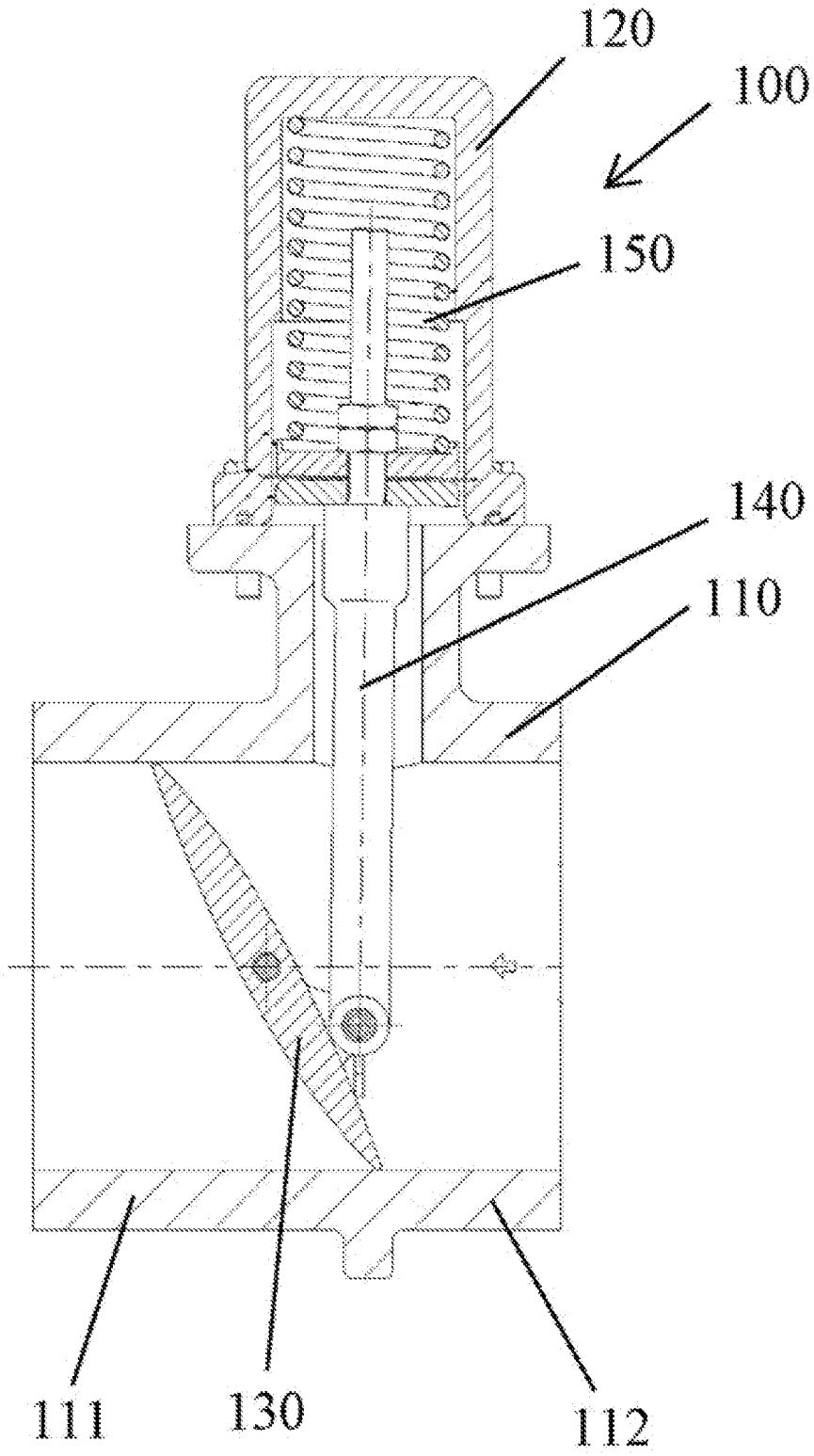
FIG. 2 is a schematic diagram of a pneumatic valve according to an embodiment of the present invention.

Referring to FIG. 2, it illustrates an embodiment of a pneumatic valve applied to a refrigeration system according to the present invention. Specifically, the pneumatic valve 100 includes a valve body 110 and a drive gas phase refrigerant chamber 120. The valve body 110 includes an gas phase refrigerant inlet section 111 and an gas phase refrigerant outlet section 112; the gas phase refrigerant inlet section 111 is connected to the economizer, and the gas phase refrigerant outlet section 112 is connected to the compressor. It should be noted that the gas phase refrigerant inlet section 111 and the gas phase refrigerant outlet section 112 herein do not have an evident distinction boundary in the valve body 110, but are only used for expressing two sections that are not in communication with each other when the valve body 110 is switched off. There is a pivotable baffle plate 130 between the gas phase refrigerant inlet section 111 and the gas phase refrigerant outlet section 112, and the pivotable baffle plate 130 is hinged to one end of a drive rod 140 and is driven by the drive rod 140; the other end of the drive rod 140 extends into the drive gas phase refrigerant chamber 120, and is supported by a spring 150 in the drive gas phase refrigerant chamber 120. It is thus clear that, without driving of an external pressure, the spring 150 may press the drive rod 140 to the lowest side, thereby rotating the baffle plate 130 linked with the drive rod 140 to a position where it cuts off the gas phase refrigerant inlet section 111 and the gas phase refrigerant outlet section 112. In this case, pressures in the drive gas phase refrigerant chamber 120 and the valve body 110 should be kept close to each other, that is, both the pressures in the drive gas phase refrigerant chamber 120 and the valve body 110 should be close to the pressure in the economizer. At this point, the first gas phase refrigerant path 800 connecting the drive gas phase refrigerant chamber 120 and the evaporator 300 should be switched off. It is desired in the present invention that, when the refrigeration system starts or when a large amount of liquid phase refrigerant is accumulated in the economizer, the pneumatic valve 100 can be kept in the state described above, thereby avoiding liquid impact.

After a period of time since the start of the refrigeration system or after the amount of the liquid phase refrigerant accumulated in the economizer is reduced, in order to resume normal work of the flow path between the economizer and the compressor, it is necessary to open the pneumatic valve 100. At this point, the first gas phase refrigerant path 800 should be switched on. Then, the pressure in the drive gas phase refrigerant chamber 120 will be close to that in the evaporator, while the pressure in the valve body 110 is still close to that in the economizer (generally may greater than the pressure in the evaporator), which will result in a pressure difference between the two. As the pressure difference changes, after it increases to exceed a pressure applied to the drive rod 140 by the spring 150, the baffle plate 130 will be pushed to rotate upwards, and thus the drive rod 140 linked with the baffle plate 130 is enabled to move upwards against the spring. As the baffle plate 130 rotates, a switching gap will exist between the gas phase refrigerant inlet section 111 and the gas phase refrigerant outlet section 112, such that gas phase refrigerant can be sucked into the compressor from the economizer to achieve normal operation. When the pressure difference constantly increases, the gap will constantly expand and will be thoroughly opened finally, achieving complete switching-on of the valve body 110.

After the refrigeration system of the present invention is described in detail, a start control method applied to the refrigeration system will be described as follows.

The method includes at least the following steps: S100 is performed, in which the first valve is kept in a closed state before the refrigeration system starts, thereby keeping the first gas phase refrigerant path in an off state; at this point, there is no pressure difference between the valve body and the drive gas phase refrigerant chamber of the pneumatic valve, and thus the valve body will be kept in a closed state, so that the economizer will not be in communication with the compressor, avoiding the possibility that the compressor sucks in the liquid phase refrigerant from the interior of the economizer. Then S200 is performed, in which a first parameter related to the stock of liquid phase refrigerant in the economizer is read and analyzed after the refrigeration system starts; and S300 is performed to make corresponding control according to a judgment result: the first valve is kept in a closed state when the first parameter represents that the stock of liquid phase refrigerant in the economizer is higher than a first threshold, and at this point, the first gas phase refrigerant path is in an off state; in this case, it is considered that, once the pneumatic valve is opened, the compressor may still suck in the liquid phase refrigerant from the interior of the economizer, and thus the pneumatic valve is still kept closed. When the first parameter represents that the stock of the liquid phase refrigerant in the economizer is lower than the first threshold, the first valve is opened, and at this point, the first gas phase refrigerant path is in an on state. In this case, it is considered that the compressor cannot suck in the liquid phase refrigerant from the interior of the economizer, and thus the pneumatic valve can be opened, such that the flow path between the compressor and the economizer is connected and begins to operate normally.

Optionally, the control method can be further refined. For example, S400 is performed, in which the pressure difference between the valve body and the drive gas phase refrigerant chamber is read and analyzed after the first gas phase refrigerant path is switched on; and the valve body is partially switched on when the pressure difference is greater than a first pressure difference threshold. Alternatively, when the pressure difference is greater than a second pressure difference threshold, the valve body is completely switched on, to achieve the control over the flow of the refrigerant entering an intermediate state of the compressor from the economizer. As an example, the present invention, upon experiment, provides several specific implementation thresholds. For example, the first pressure difference threshold is 10 psig, and the second pressure difference threshold is 20 psig.

As an implementation, the first parameter in the method is: a time period for which the refrigeration system has run after start. It can be known upon experiment that, generally, within a period of time since the start of the refrigeration system, that is, when the time period is lower than a first time period threshold, the amount of the liquid phase refrigerant accumulated in the economizer is still higher than the first threshold, the liquid phase refrigerant is still at the risk of being sucked in by the compressor, and thus, at this point, the first gas phase refrigerant path should be still kept off. After a period of time since the start of the refrigeration system, that is, when the time period is higher than the first time period threshold, the amount of the liquid phase refrigerant accumulated in the economizer will be lower than the first threshold, and therefore the liquid phase refrigerant is insufficient to be sucked into the compressor when the flow path from the economizer to the compressor is opened. At this point, the first gas phase refrigerant path can be switched on, and then the pneumatic valve is opened.

Similarly, as an example, the present invention, upon experiment, provides several specific implementation thresholds. For example, the first time period threshold is 0 to 10 minutes. Alternatively, more preferably, the first time period threshold is 2 to 5 minutes.

Persons skilled in the art should know that the specific numbers provided in the context are all given for a system with a particular refrigeration capability. When the refrigeration system changes, according to the teaching of the present invention, persons skilled in the art can also obtain other numerical ranges without making creative efforts.

As another implementation, the first parameter in the method is: a liquid level of the liquid phase refrigerant in the economizer. It can be known upon experiment that, when the liquid level is higher than a first liquid level threshold, the stock of the liquid phase refrigerant in the economizer is still higher than the first threshold, the liquid phase refrigerant is still at the risk of being sucked in by the compressor, and thus, at this point, the first gas phase refrigerant path should be kept off. When the liquid level is lower than the first liquid level threshold, the stock of the liquid phase refrigerant in the economizer is lower than the first threshold, and therefore the liquid phase refrigerant is insufficient to be sucked into the compressor when the flow path from the economizer to the compressor is opened. At this point, the first gas phase refrigerant path can be switched on, and then the pneumatic valve is opened. At this point, the liquid level can be monitored by arranging a liquid level switch in the evaporator of the refrigeration system according to the foregoing embodiment in this specification.

According to the teachings of the refrigeration system and the start control method of the present invention, a start process of a refrigeration system according to an embodiment of the present invention will be described below with reference to FIG. 3 and FIG. 4.

Figure 3:
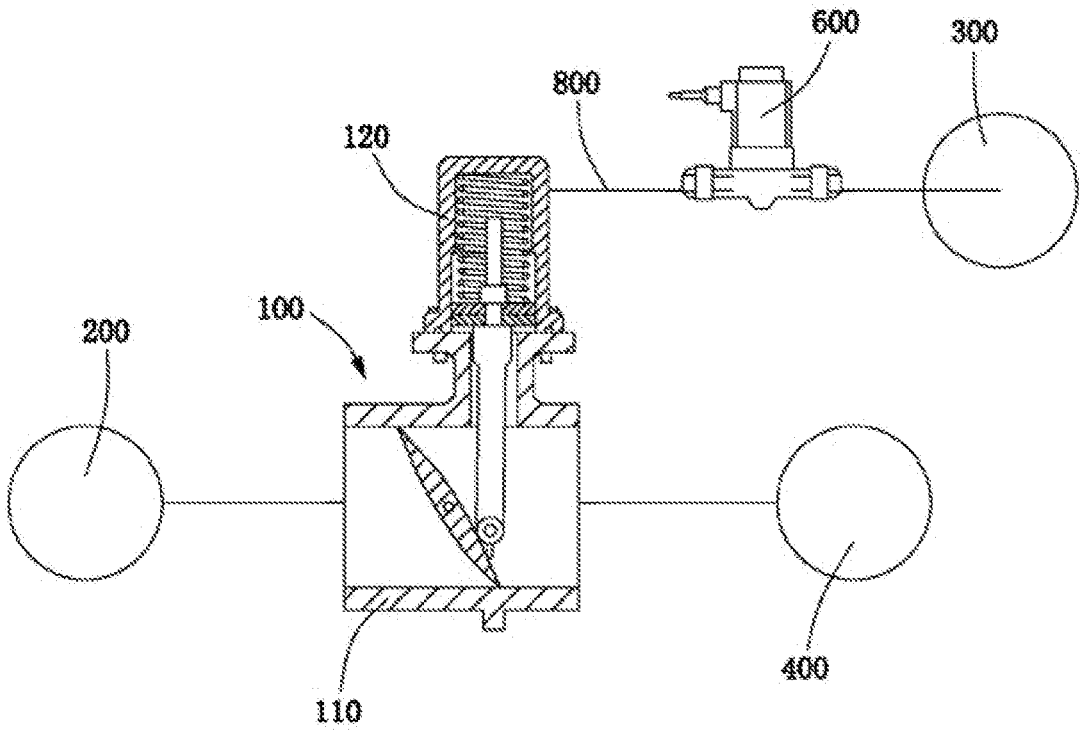
FIG. 3 is a schematic diagram of a flow path when a pneumatic valve of a refrigeration system according to an embodiment of the present invention is in a closed state.

As shown in FIG. 3, when the refrigeration system has just started, and a running time period is within the first time period threshold or a liquid level in the economizer 200 is higher than a first liquid level threshold, a large amount of liquid phase refrigerant is accumulated in the economizer 200, and at this point, the electromagnetic valve 600 is controlled to be closed to keep the first gas phase refrigerant path 800 off. As pressures in the valve body 110 and the drive gas phase refrigerant chamber 120 of the pneumatic valve 100 are both close to the pressure at the economizer 200 side, there is barely any pressure difference between the valve body 110 and the drive gas phase refrigerant chamber 120. According to the working principle of the pneumatic valve 100 described above with reference to FIG. 2, the valve body 110 will be kept closed, such that the economizer 200 and the compressor 400 are kept disconnected, thus avoiding the possibility that the compressor 400 sucks in the liquid phase refrigerant from the economizer.

Figure 4:
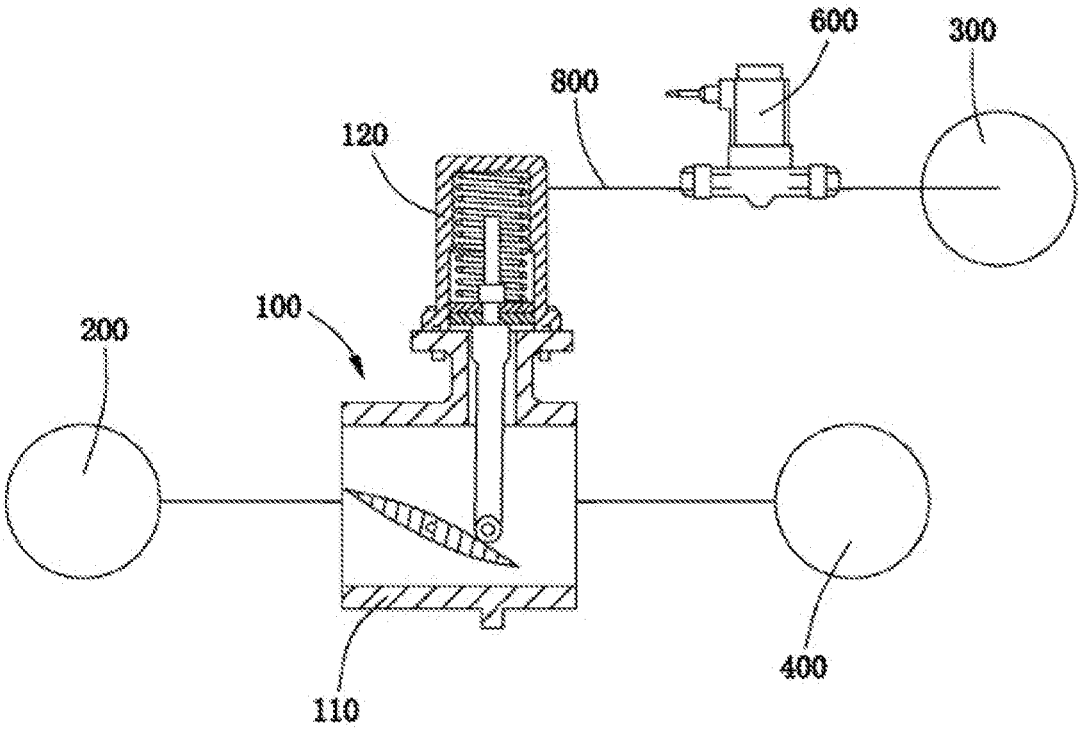
FIG. 4 is a schematic diagram of a flow path when a pneumatic valve of a refrigeration system according to an embodiment of the present invention is in an open state.

As shown in FIG. 4, as the refrigeration system runs, when the running time period exceeds the first time period threshold or the liquid level in the economizer 200 is lower than the first liquid level threshold, the liquid phase refrigerant accumulated in the economizer 200 has been reduced to a very small amount, and at this point, the electromagnetic valve 600 is controlled to be opened to keep the first gas phase refrigerant path 800 on. As the pressure of the valve body 110 of the pneumatic valve 100 is close to that at the economizer 200 side while the pressure in the drive gas phase refrigerant chamber 120 is close to that at the evaporator 300 side, there is a greater pressure difference between the valve body 110 and the drive gas phase refrigerant chamber 120. According to the working principle of the pneumatic valve 100, the valve body 110 will be partially switched on or completely switched on as the pressure difference changes, such that the economizer 200 is in communication with the compressor 400, and thus the compressor 400 can suck in the gas phase refrigerant from the economizer and begins to run normally.

In the description of the present invention, it should be understood that direction or position relations indicated by "upper", "lower", "front", "rear", "left", "right" and the like are direction or position relations based on the figures, are merely used to facilitate the description of the present invention and to simplify the description rather than indicating or implying that the indicated device or feature must have the specific direction or be constructed and operated in the specific direction, and therefore cannot be construed as a limitation to the present invention.

The above examples mainly describe the refrigeration system of the present invention and the start control method thereof. Although only some implementations of the present invention are described, persons of ordinary skills in the art should understand that the present invention may be implemented in many other manners without departing from the purport and scope of the present invention. Therefore, the illustrated examples and implementations are regarded as illustrative rather than limitative, and the present invention may cover various modifications and replacements without departing from the spirit and scope of the present invention as defined in the appended claims.

The invention claimed is:

1. A refrigeration system, comprising: a compressor, a condenser, an economizer, a throttle valve, and an evaporator which are connected via a pipeline; and a pneumatic valve that comprises a valve body and a drive gas phase refrigerant chamber, a gas phase refrigerant outlet of the economizer being connected to an interstage gas phase refrigerant inlet of the compressor via the valve body, and the drive gas phase refrigerant chamber being connected to a low pressure portion of the refrigeration system via a first gas phase refrigerant path, the low lower pressure portion having a pressure lower than that in the economizer; wherein a first valve for controlling on/off of the first gas phase refrigerant path is disposed on the first gas phase refrigerant path.

2. The refrigeration system according to claim 1, wherein the first valve is an electromagnetic valve.

3. The refrigeration system according to claim 2, wherein the electromagnetic valve is a normally-closed type electromagnetic valve.

4. The refrigeration system according to claim 1, wherein the low pressure portion is an evaporator.

5. The refrigeration system according to claim 4, wherein the drive gas phase refrigerant chamber of the pneumatic valve is connected to the top of the evaporator via the first gas phase refrigerant path.

6. The refrigeration system according to claim 1, wherein the low pressure portion is located downstream of the throttle valve.

7. The refrigeration system according to claim 6, wherein the throttle valve is a ball float valve located in the economizer.

8. The refrigeration system according to claim 1, wherein the pneumatic valve further comprises a baffle plate for controlling on/off of the valve body, and a drive rod linked with the baffle plate; one end of the drive rod is connected to the baffle plate, and the other end thereof extends into the drive gas phase refrigerant chamber; and the baffle plate is driven by a pressure difference between the valve body and the drive gas phase refrigerant chamber.

9. The refrigeration system according to claim 8, wherein the baffle plate may be rotatably disposed in the valve body; and the drive rod is hinged to the baffle plate; wherein, when the pressure in the valve body is greater than that in the drive gas phase refrigerant chamber, the drive rod drives the baffle plate to rotate, so as to switch on the valve body; and/or when the pressure in the valve body is equal to that in the drive gas phase refrigerant chamber, the drive rod drives the baffle plate to rotate, so as to switch off the valve body.

10. A start control method for the refrigeration system according to claim 1, comprising:

keeping the first valve in a closed state before the refrigeration system starts, thereby keeping the first gas phase refrigerant path in an off state;

reading and analyzing a first parameter related to the stock of liquid phase refrigerant in the economizer after the refrigeration system starts; and keeping the first valve in a closed state when the first parameter represents that the stock of the liquid phase refrigerant in the economizer is higher than a first threshold, wherein, at this point, the first gas phase refrigerant path is in an off state, and the economizer and the compressor are not in communication;

and/or opening the first valve when the first parameter represents that the stock of the liquid phase refrigerant in the economizer is lower than the first threshold, wherein, at this point, the first gas phase refrigerant path is in an on state, and the economizer and the compressor are in communication.

11. The start control method according to claim 10, further comprising:

reading and analyzing a pressure difference between the valve body and the drive gas phase refrigerant chamber after the first gas phase refrigerant path is switched on; and partially switching on the valve body when the pressure difference is greater than a first pressure difference threshold.

12. The start control method according to claim 11, wherein the first pressure difference threshold is 10 psig.

13. The start control method according to claim 11, wherein the reading and analyzing further comprises: completely switching on the valve body when the pressure difference is greater than a second pressure difference threshold.

14. The start control method according to claim 13, wherein the second pressure difference threshold is 20 psig.

15. The start control method according to claim 10, wherein the first parameter is a time period for which the refrigeration system has run after start; when the time period is higher than a first time period threshold, the stock of the liquid phase refrigerant in the economizer is lower than the first threshold; and/or when the time period is lower than the first time period threshold, the stock of the liquid phase refrigerant in the economizer is higher than the first threshold.

16. The start control method according to claim 15, wherein the first time period threshold is 0 to 10 minutes.

17. The start control method according to claim 16, wherein the first time period threshold is 2 to 5 minutes.

18. The start control method according to claim 10, wherein the first parameter is a liquid level of the liquid phase refrigerant in the economizer; when the liquid level is lower than a first liquid level threshold, the stock of the liquid phase refrigerant in the economizer is lower than the first threshold; and/or when the liquid level is higher than the first liquid level threshold, the stock of the liquid phase refrigerant in the economizer is higher than the first threshold.

* * * * *